US005140294A

United States Patent [19]

Rohrer et al.

[11] Patent Number: 5,140,294

[45] Date of Patent: Aug. 18, 1992

[54] SAFETY FUSE ELEMENT AND METHOD OF MANUFACTURING SUCH SAFETY FUSE ELEMENT

[75] Inventors: Heinrich Rohrer, Sachseln; Werner Staubli, Kriens, both of Switzerland

[73] Assignee: Schurter AG, Lucerne, Switzerland

[21] Appl. No.: 716,797

[22] Filed: Jun. 18, 1991

[30] Foreign Application Priority Data

Aug. 20, 1990 [CH] Switzerland ..... 02696/90

[51] Int. Cl.[5] ..... H01H 85/38

[52] U.S. Cl. ..... 337/278; 337/252; 337/273

[58] Field of Search ..... 337/278, 279, 280, 282, 337/273, 231, 234, 252, 246; 29/623

[56] References Cited

U.S. PATENT DOCUMENTS 4,703,299 10/1987 Vermij ..... 337/246
4,851,806 7/1989 Rohrer et al. ..... 337/234

FOREIGN PATENT DOCUMENTS 566641 9/1975 Switzerland .
1417488 12/1975 United Kingdom .

*Primary Examiner*—Harold Broome

*Attorney, Agent, or Firm*—Sandler, Greenblum & Bernstein

[57] ABSTRACT

A continuous hollow compartment open at both opposite ends thereof is arranged within an electrically insulating housing. Tubular portions of end contacts extend into ends of the hollow compartment and are completely covered at their inner surfaces by an arc-inhibiting screen. Flat portions of the end contacts form clamping locations and solder pins. The ends of a fuse wire and the ends of the screen are clamped at the clamping locations. The solder pins form a respective wave solder region and a reflow solder region. During manufacture of the safety fuse element, the tubular-shaped end contacts are inserted into the ends of the hollow compartment of the housing. Then there is drawn-in the screen and the fuse wire and the flattenable portions of the end contacts are flattened to form the flat portions, so that there are clamped at the clamping locations the ends of the fuse wire and the ends of the screen. Now the flat portions are bent to form the solder pins. The safety fuse element can be completely automatically fabricated and completely automatically deployed. Such safety fuse element possesses a considerable inhibiting of electrical arcs with small dimensions and is suitable for use as a surface mount device (SMD).

17 Claims, 2 Drawing Sheets

SAFETY FUSE ELEMENT AND METHOD OF MANUFACTURING SUCH SAFETY FUSE ELEMENT

BACKGROUND OF THE INVENTION

1. Field of the Invention

The present invention relates to a new and improved safety fuse element or fuse link and method of manufacturing such safety fuse element or fuse link.

In its more specific aspects, the safety fuse element of the present development is of the type comprising an electrically insulated housing within which there is located or formed a hollow compartment open at both of the opposite ends thereof and continuously extending along the longitudinal axis of the housing. Two electrically conductive end contacts connected with the housing are located at the region of the open ends of the housing. A fuse wire or conductor is arranged within the housing and extends approximately concentrically with respect to the longitudinal axis of the housing. Each end of the fuse wire or conductor is electrically conductively connected with an associated one of the end contacts.

2. Discussion of the Background and Material Information

Safety fuse elements or fuse links of the aforementioned type, which are predominantly termed safety fuse inserts, and also fuse inserts, are known to the art in different constructions. In particular, when such safety fuse elements are miniaturized, there exists a real need to construct such safety fuse elements to be arc-inhibiting or arc-suppressing. However, due to their small dimensions the present day conventional measures are extensively unsuitable for achieving this objective. Even though the known safety fuse elements sometimes, in fact, possess really small dimensions, they are still not practically suitable for use as surface mounted devices (SMD).

A spate of publications exist concerning "surface mounted techniques" or "surface mounted technology" (SMT) and "surface mounted devices" (SMD). With SMT the connection pins or legs of the SMD are soldered at a soldering zone or pad by means of the reflow soldering method or the wave soldering method.

SUMMARY OF THE INVENTION

Therefore, with the foregoing in mind, it is a primary object of the present invention to provide an improved safety fuse element and method of manufacturing such safety fuse element, which are not afflicted with the shortcomings and drawbacks of the prior art.

Another and more specific object of the present invention aims at the provision of an improved safety fuse element which, notwithstanding its exceedingly small dimensions, possesses arc-inhibiting or arc-suppressing properties and can be used as a SMD for SMT, and apart from its small dimensions is further manifested by its capability of being used in conjunction with both reflow soldering and wave soldering, its superb operational reliability as well as relatively low cost, and possesses a great capability of inhibiting the formation of electrical arcs.

Still a further noteworthy object of the present invention is the provision of an improved construction of safety fuse element which readily lends itself to completely automated manufacture and also for the automated mounting thereof at printed circuit boards or the like.

Now in order to implement these and still further objects of the present invention, which will become more readily apparent as the description proceeds, the safety fuse element or fuse link of the present development is manifested, among other things, by the features that the inner surface of each of both end contacts which confronts the hollow compartment is completely covered by an arc-inhibiting screen.

According to a further aspect of the present invention, the safety fuse element is constructed as a SMD, in which both of the end contacts each engage or extend by means of their associated tubular portion into the interior of the associated end of the hollow compartment, and a flat portion formed at the neighboring tubular portion of each end contact forms, on the one hand, as a clamping location or point the electrically conductive attachment for one of the ends of the fuse wire and, on the other hand, a solder pin or leg. Both of the solder pins or legs extend away or outwardly from the same side of the longitudinal axis of the housing. As stated, the inner surface of each of both of the tubular portions of the end contacts is completely covered by the arc-inhibiting screen.

Regarding the connection of the end contacts with the fuse wire or conductor, it is firstly noted that as concerns the connection of an end of the fuse wire or conductor with an associated end contact there are essentially known to the art the following discussed safety fuse elements or fuse links. Moreover, as a general rule, the housing thereof is constructed as an electrically insulating tube or tubular member and the end connections, as a general rule, are constituted by caps which are seated upon the outside of the electrically insulating tube or tubular member. The following explanations of the state of the art are pertinent thereto:

(a) The end of the fuse wire guided through a hole of the cap is connected with the cap by a so-called external solder location or point. Soldering must be accomplished with adequate infeed of thermal energy in order to obtain a good electrical contact. Too great infeed of thermal energy can cause undesired changes in the fuse wire (for example, alloy). Since the aggressive or corrosive flux agents, which are required for the soldering of fuse wires formed of resistance material, can not be removed from the finished safety fuse insert, there exists the danger that there are produced faulty results due to the corrosion caused by flux agent residues remaining in the safety fuse insert. Therefore, such safety fuse inserts containing fuse wires formed of resistance material are at least to be considered as problematic as concerns the fabrication thereof. Also automated manufacture is thus subject to limitations, and manual soldering results in high fabrication costs.

(b) The end of the fuse wire located between the electrically insulating tube defining the housing and the end closure constructed as a cap, is connected with the bottom of the cap internally of the safety fuse element by means of a so-called internal solder location or point. The amount of thermal energy required for producing a good internal solder location or point is difficult to control if there is desired a positive melting of the tin component of the solder introduced into the interior of the cap, but without any overheating of the internal solder location or point, because otherwise there can arise undesired alterations (for example, alloys). The flux agent can deposit as an insulating layer about the fuse wire and/or can act corrosively which, particularly in the case of the previously mentioned aggressive or corrosive flux agents used with fuse wires or conductors formed of electrically resistance material, practically precludes the use of such resistance fuse wires or conductors. The unavoidable contact of the fuse wire or conductor with the electrically insulating tube and the inclined disposition of such fuse wire or conductor within the electrically insulating tube can result in unforeseen scattering. Moreover, the soldering operation is associated with problems.

(c) The end of the fuse wire is retained by a pure clamping action between the cap and the electrically insulating tube. The clamping forces which are produced in consideration of the strength of the electrically insulating tube, can markedly fluctuate, for instance, due to tolerances in the diameter of the electrically insulating tube. During pressing of the cap upon the electrically insulating tube, it is possible to over-elongate or even rupture the fuse wire or conductor due to the tensile forces. Also, in this case there are present uncertainties because of the unavoidable contact of the fuse wire with the electrically insulating tube.

(d) With the prior art safety fuse element as considered at the outset of this disclosure, and as disclosed in the commonly assigned Swiss Patent No. 566,641, published Sep. 9, 1975 and the cognate British Patent No. 1,417,488, published Dec. 10, 1975, attempts were made to overcome the aforementioned drawbacks in that, each end of the fuse wire was clamped within the electrically insulating tube between two approximately diametrically opposite flaps or tabs arranged in the associated cap approximately concentrically with respect to the electrically insulating tube. This safety fuse element indeed affords a relatively free selection of the fuse wire and precluded the drawbacks of the aforementioned three types of safety fuse inserts. However, in actual practice problems did arise which unexpectedly hampered the possibility of undertaking automated manufacture. Also, the requirement of having to close the unavoidable open cap end in a separate working operation if, as usually was the case, there was desired a filling of the safety fuse element with a granular arc extinguishing medium, was undesirable.

The aforementioned known safety fuse elements were neither suitable for SMT nor for automated fabrication.

Due to the inventive construction of the safety fuse element as previously explained, it is now possible to employ such in SMT and to completely automate the fabrication of such safety fuse elements.

Additionally, the arc-inhibiting screen or shield can be simply incorporated also during the automated fabrication.

According to a preferred embodiment of the present invention, the screen or shield extends into each of the two flat portions of the end contacts, and each flat portion protrudes outwardly from the associated tubular portion of the end contact in the direction of the longitudinal axis of the housing.

In conformity with a still further preferred embodiment of the invention, the screen or shield is constructed as a small tube or tubular member, especially an uninterrupted or nonpunctured tube formed of insulating material and interconnecting both of the tubular portions of the end contacts.

A particularly preferred construction of the present invention contemplates that the screen or shield is at least partially and, preferably completely formed of plastic material, especially from polytetrafluoroethylene. This screen or shield is provided in the form of a polytetrafluoroethylene hose or small tube with tight walls. The fact that exceptional results are realized with this measure is rather astounding since the belief existed that corresponding materials had to be porous or, in fact, even granular.

The housing can be simply automatically manufactured and with standard plastic molding precision by injection molding techniques and, if desired, the small tubes or tubular portions of the end contacts can be already injection molded. If it is desired not to injection mold the small tubes because such measure can be associated with a certain expense, then there can be only fabricated the housing and such delivered at the appropriate time to an apparatus for the assembly of the safety fuse element.

Whatever the case, the small tubes, if desired, can be provided with the arc-inhibiting screen prior to assembly in the housing, although it is presently preferred to provide the screen at a later point in time.

After the small tubes or tubular portions have been mounted in the housing and there has been provided the screen, which operations can be automated, there can be automatically drawn-in the fuse wire and the small tubes or tubular portions flattened, in order to clamp the ends of the fuse wire and, if necessary or desired, also the ends of the screen. The thus obtained flat portions then can be automatically bent to form the solder pins.

The thus obtained safety fuse elements packaged in tapes, blister packs and magazines and so forth, then can be delivered to assembly apparatuses for the fabrication of printed circuit boards where an automated mounting of the safety fuse elements can take place.

The flat portions are preferably arranged externally of the housing and preferably contain a portion extending in the direction of the longitudinal axis and neighboring the tubular portion.

By appropriately supporting the tubular portion it is possible to prevent undesired deformation of such tubular portion during flattening of the flat portion, that is, during flattening of that part of the tubular portion which results in the formation of the flat portion. Such undesired deformation of the tubular portion could have an adverse affect upon the connection of the tubular portion with the housing.

The tubular portions and the flat portions extensively seal the hollow compartment. Due to the arc-inhibiting nature of the screen or shield such, of course, possesses an arc extinguishing action, so that there can be dispensed with the need to incorporate the usual porous arc extinguishing agents, whether such be granular or paper-like. This is particularly advantageous because of the small size of the safety fuse elements. In any event, even if there is contained within the safety fuse element an arc-extinguishing material, such as a granular material, like, for example, quartz sand, the safety fuse element is sealing closed with respect thereto.

Each flat portion advantageously protrudes, especially at the region of the clamping location or point, along a certain, usually small path axially of the associated tubular portion before it extends in a bent direction out of the longitudinal axis of the housing. At this location there can be also clamped the screen without there arising any difficulties. It is then possible to fixedly hold, for instance, up to this location the end contacts during bending, so that the bending forces are not transmitted to the tubular portion inserted into the housing.

The actual formation of the solder pins from both of the flat portions can be accomplished practically without limitation, however, there are preferred two solder pin shapes or constructions which have proven themselves in practice, namely, the one which is the so-called Z-shape and the other which is more or less C-shape. With the C-shape of the solder pins there can be obtained a more or less pronounced resilient or spring characteristic and/or a certain dilatation compensation because of the size of the bending radii. Both solder pin shapes are suitable for use with both soldering techniques previously discussed.

As alluded to above the invention is not only concerned with an improved construction of safety fuse element, but also is directed to an improved method of manufacturing such safety fuse element, which comprises the steps of producing a housing, inserting two still completely tubular end contacts into opposite ends of the housing, inserting a screen, especially a tubular screen and a fuse wire extending through the tubular screen into the hollow compartment of the housing and into the tubular end contacts, flattening a portion of each of the tubular end contacts to form respective flat portions of the tubular end contacts, clamping at clamping locations, formed during flattening of the portions of the tubular end contacts, a respective end of the fuse wire and, if desired, the ends of the tubular screen, and bending away from the longitudinal axis of the housing at least a part or portion of each flat portion of each end contact and forming at each such bent portion a solder pin.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
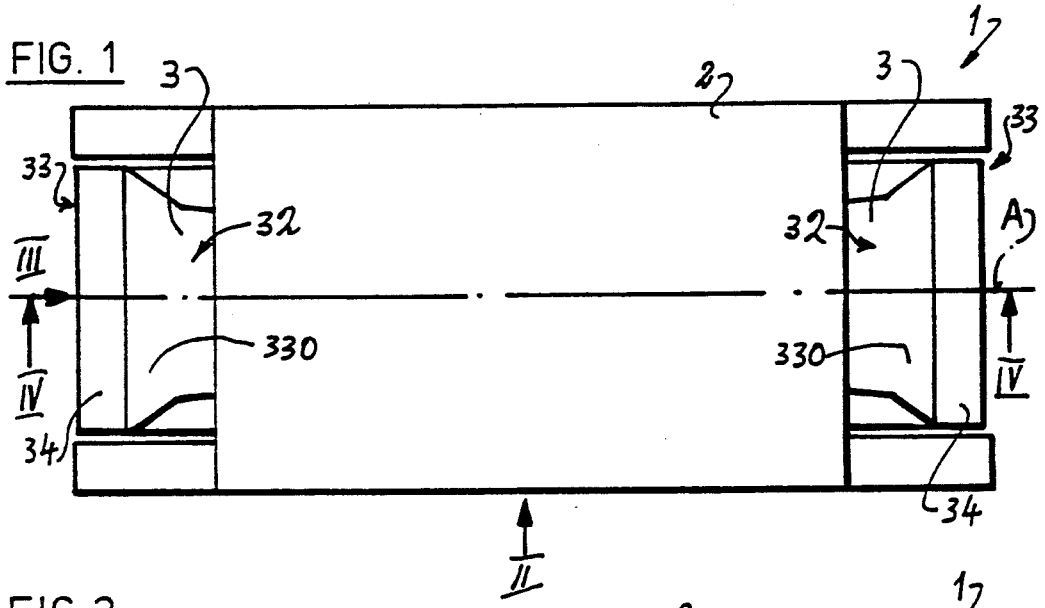
FIG. 1 is an enlarged top plan view of a first exemplary embodiment of a safety fuse element in SMD construction.
Figure 2:
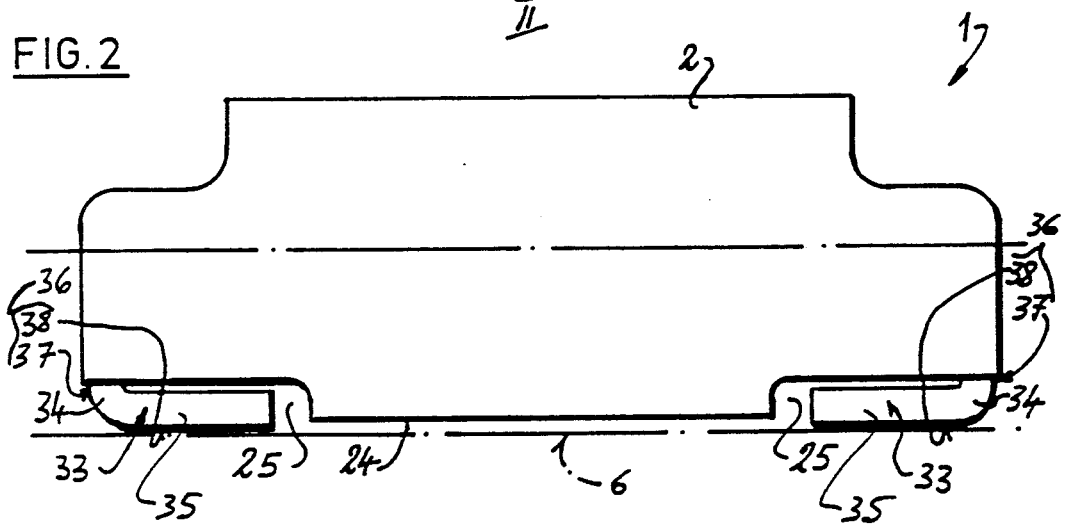
FIG. 2 is a side view of the safety fuse element depicted in FIG. 1 looking in the direction of the arrow II thereof.
Figure 3:
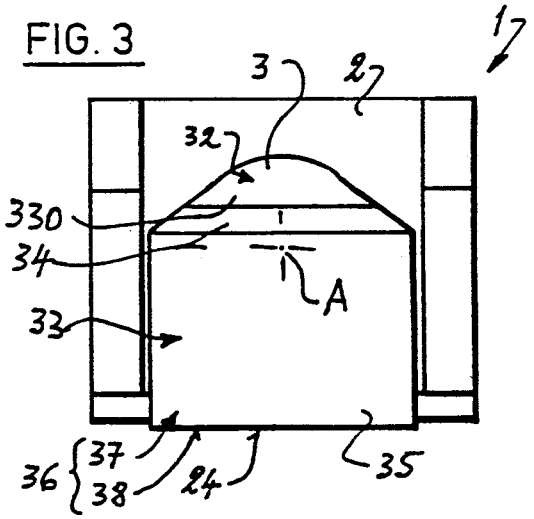
FIG. 3 is an end view of the safety fuse element depicted in FIG. 1 looking in the direction of the arrow III thereof.

Describing now the drawings, it is to be understood that only enough of the construction of the safety fuse element or fuse link has been depicted therein, in order to simplify the illustration, as needed for those skilled in the art to readily understand the underlying principles and concepts of the present invention.

Turning attention now to the first exemplary embodiment of safety fuse element 1 depicted in FIGS. 1 to 4, it will be recognized that the same comprises an elongate housing 2 extending along the longitudinal or lengthwise axis A thereof. This housing 2 is formed of a suitable electrically insulating material, such as, for instance, plastics material, ceramics or the like. Internally of the housing 2 there is located a continuous hollow compartment or chamber 21 which is open at its opposed ends 22 and extends along the longitudinal axis A.

A metallic end contact 3, formed from an initially completely tubular member or small tube, is inserted into each end 22 of the hollow compartment 21. Both of these metallic end contacts 3 are electrically conductively connected with one another by means of a fuse wire or conductor 4 located substantially along the longitudinal axis A of the housing 2. Each of the two end contacts 3 is firmly seated by means of its tubular portion 31 in the associated end 22 of the hollow compartment 21. The fixed attachment between the end contacts 3 and the ends 22 of the hollow compartment 21 can be achieved in known random manner, for example, by adhesive bonding, clamping, extrusion coating and the like.

Furthermore, it will be observed that the tubular portion 31 of each end contact 3 gradually transforms by means of a transition portion 32 into a flat portion 33. In the first part 330 of the flat portion 33 of each end contact 3 there is clamped an associated end 51 of an arc-inhibiting screen or shield 5. There then follows at each end contact 3 the clamping location or point 34 where there is electrically conductively attached a respective end 41 of the fuse wire 4 with the associated end contact 3.

Then the flat portions 33 form the solder pins or legs 35. It will be seen that although the clamping locations or points 34 are still located along the longitudinal axis A, the solder pins 35 have been bent out of or away from such longitudinal axis A of the housing 2.

Figure 4:
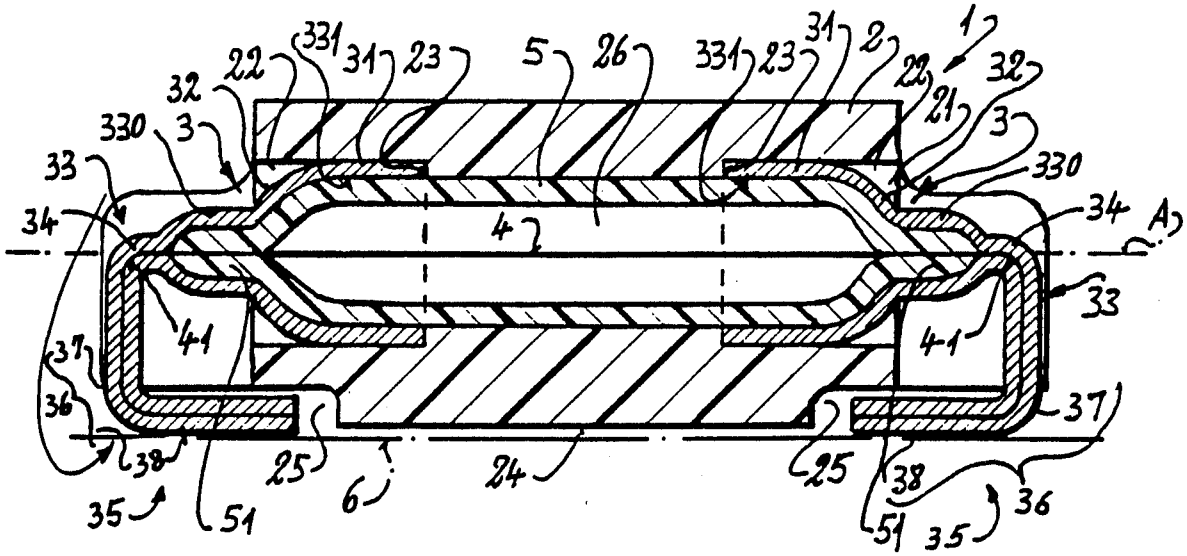
FIG. 4 is a cross-section view of the safety fuse element depicted in FIG. 1, taken substantially along the line IV—IV thereof.

During manufacture of the safety fuse element 1, each of both end contacts 3 extends in the direction of the longitudinal axis A externally of the hollow compartment 21 and is readily accessible for engagement by a suitable gripper element or tool for squeezing of such end contacts 3 at defined regions. In FIG. 4, each of both clamping locations 34 is depicted in its squeezed or pinched condition in which it mechanically retains an end 41 of the fuse wire 4 and also electrically conductively connects the end contacts 3 with one another by means of such fuse wire 4. Moreover, there is provided a complete covering of the inner surface 331 of the tubular portion 31 by the tube-shaped or tubular screen or shield 5, the ends 51 of which are enclosed about the fuse wire 4 at the associated clamping locations 34.

There is also obtained a complete screening or shielding of the inner compartment. This screening or shielding is realized by means of a polytetrafluoroethylene hose or small tube having tight or sealed walls and defining the screen or shield 5. That the use of such screen or shield 5 brings good results is that much more surprising since those skilled in the art were previously of the opinion that appropriate materials should be porous or even granular.

The tubular portions 31 flushly merge with shoulders 23 of the hollow compartment 21 which enlarge such hollow compartment 21 at the region of the opposite ends 22 thereof, so that these tubular portions 31 extend at their inner side or internally in alignment with the central region 26 of the hollow compartment 21. As a result, there is exceedingly facilitated the insertion of the screen or shield 5 and the drawing-in of the fuse wire or conductor 4 during the course of fabrication of the safety fuse element or fuse link As explained, the flat portion 33 of each end contact 3 is subsequently formed into the solder pins or legs 35 at the clamping locations 34.

Each of the solder pins 35 is first bent at substantially right angles with respect to the longitudinal or lengthwise axis A of the housing 2 in the direction of the under side 24 of the housing 2 to form the wave solder region 37, and then is bent back substantially parallel to the longitudinal or lengthwise axis A of the housing 2 into a recess 25 at the under side 24 of the housing 2 to form the reflow solder region 38. Both of the solder regions 37 and 38 collectively form a solder portion or section 36 of the corresponding solder pin 35.

Through the provision of the recesses 25 there is ensured that the reflow solder regions 38 are indeed protected within the housing 2, but extend, transversely with respect to the longitudinal axis of the housing 2, beyond the under side 24 to such an extent that there is present a certain spacing with respect to a confronted printed circuit board 6 generally depicted in chain-dot lines, this spacing serving for receiving a suitable bonding agent.

Figure 5:
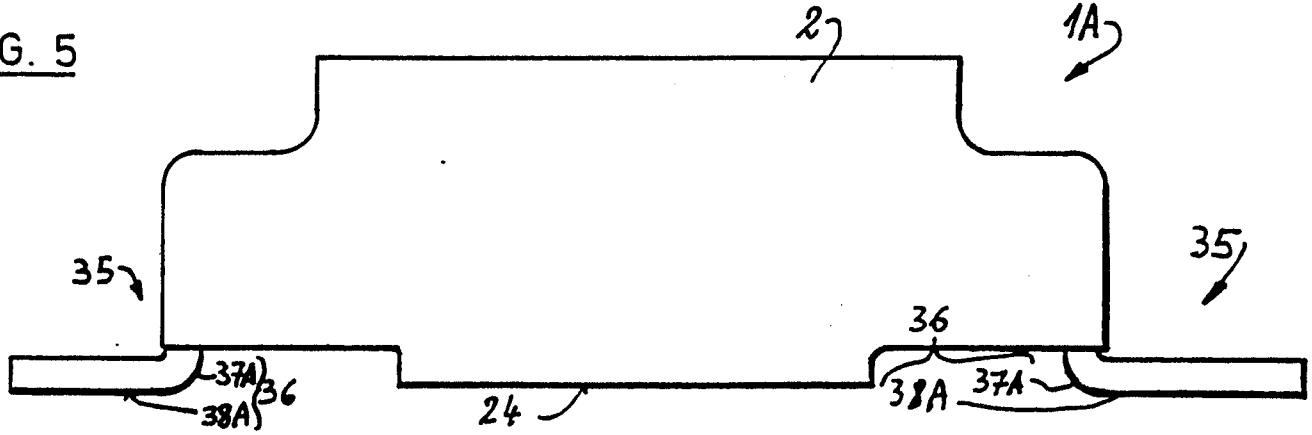
FIG. 5 is a side view, similar to the showing of FIG. 2, of a second embodiment of safety fuse element which only primarily differs from the first embodiment of safety fuse element depicted in FIGS. 1 to 4, as concerns the shape of the solder pins.

With respect now to the modified second embodiment of safety fuse element or fuse link 1A, depicted in FIG. 5, wherein there have been used the same reference characters as employed for the first embodiment of FIGS. 1 to 4, to denote the same component, however sometimes followed by the suffix "A" to denote an analogous component, it is to be understood this modified second embodiment primarily differs from the first embodiment through a different configuration of the solder pins or legs 35A, the solder portions 36 of which are bent away from the housing 2 and at that location form the wave solder region 37A and the reflow solder region 38A.

At this point there will be now considered the manufacture of the first exemplary embodiment of safety fuse element or fuse link 1:

The previously fabricated plastic housing 2 possesses the longitudinal or lengthwise axis A with respect to which there coaxially extends the hollow compartment 21. The end contacts 3, which are still of tubular shape, are displaced with a clamping fit along the longitudinal or lengthwise axis A of the housing 2 until contacting the shoulders 23 located at the region of the open ends 22 of the hollow compartment 21 without an air gap and there are then drawn in the screen 5 and the fuse wire 4. Thereafter there are clamped the ends 41 of the fuse wire 4 and the ends 51 of the screen 5 at the clamping locations or points 34 and 330 of the flat portions 33 which have been produced by flattening or squeezing defined portions of the small tubes or tubular members forming the end contacts 3. By appropriately bending the formed flat portions 33, as previously explained, there are produced the solder pins 35 and there is thus fabricated the safety fuse element or fuse link 1 of the embodiment of FIGS. 1 to 4.

It should be apparent that the modified second embodiment of safety fuse element or fuse link IA depicted in FIG. 5, can be correspondingly produced but through some what different forming or bending of the solder pins 35A as previously explained.

While there are shown and described present preferred inventive embodiments, it is distinctly to be understood the invention is not limited thereto, but may be otherwise variously embodied and practiced within the scope of the following claims.

What is claimed is:

1. A safety fuse element, comprising:

an electrically insulated housing having an inner surface and a longitudinal axis;

said electrically insulated housing containing a hollow compartment open at opposite ends thereof and continuously extending along the longitudinal axis of the electrically insulated housing;

two electrically conductive end contacts connected with the electrically insulated housing;

each electrically conductive end contact being located at a region of a respective open end of the electrically insulated housing;

a fuse wire having oppositely situated ends;

said fuse wire being arranged within the electrically insulated housing and extending approximately concentrically with respect to the longitudinal axis of the electrically insulated housing;

each end of the fuse wire being electrically conductively connected with an associated one of the electrically conductive end contacts;

each electrically conductive end contact having an inner surface confronting the hollow compartment; and an arc-inhibiting screen completely covering the inner surface of each of both end contacts; and said arc-inhibiting screen extending from one of said two electrically conductive end contacts to the other of said two electrically conductive end contacts in order to enclose the hollow compartment, whereby electrical arcs formed in the hollow compartment are prevented from coming into contact with the inner surface of each of the end contacts and the inner surface of the electrically insulated housing.

2. The safety fuse element as defined in claim 1, wherein:

each electrically conductive end contact has a tubular portion and a neighboring flat portion;

said hollow compartment having oppositely situated ends;

the safety fuse element is constructed as a SMD, in which each of the electrically conductive end contacts extend by means of said tubular portion thereof into the interior of the associated end of the hollow compartment;

said flat portion neighboring the tubular portion of each electrically conductive end contact forms as a clamping location an electrically conductive attachment for an associated one of the ends of the fuse wire and a solder pin; and each of the solder pins extending away from the same side of the longitudinal axis of the housing.

3. The safety fuse element as defined in claim 2, wherein:

each flat portion extending outwardly away from the associated tubular portion in the direction of the longitudinal axis of the electrically housing insulated; and the arc-inhibiting screen extending into both of the flat portions.

4. The safety fuse element as defined in claim 2, wherein:

the arc-inhibiting screen comprises an electrically insulating tubular member interconnecting both of the tubular portions of the electrically conductive end contacts.

5. The safety fuse element as defined in claim 4, wherein:

the electrically insulating tubular member comprises an uninterrupted tubular member.

6. The safety fuse element as defined in claim 4, wherein:

the arc-inhibiting screen is at least partially formed of a plastic material.

7. The safety fuse element as defined in claim 6, wherein:

said plastic material is polytetrafluoroethylene.

8. The safety fuse element as defined in claim 4, wherein:

the arc-inhibiting screen is completely formed of a plastic material.

9. The safety fuse element as defined in claim 8, wherein:

said plastic material is polytetrafluoroethylene.

10. The safety fuse element as defined in claim 2, wherein:

said electrically insulated housing has an under side;

each of the solder pins of each of the flat portions comprises a portion extending away from the longitudinal axis of the electrically insulated housing followed by a solder portion extending substantially parallel to said longitudinal axis of the electrically insulated housing;

each said solder portion being arranged at the under side of the electrically insulated housing such that each said solder portion protrudes beyond the under side of the electrically insulated housing in a direction transverse to said longitudinal axis of the electrically insulated housing; and the under side of the electrically insulated housing, during soldering of the safety fuse element at a printed circuit board, confronting the printed circuit board.

11. The safety fuse element as defined in claim 10, wherein:

the underside of the electrically insulated housing is provided with recess means; and each said solder portion protruding into said recess means.

12. The safety fuse element as defined in claim 2, wherein:

said electrically insulated housing has an under side;

each of the solder pins of each of the flat portions comprises a portion extending away from the longitudinal axis of the electrically insulated housing followed by a solder portion extending substantially parallel to said longitudinal axis of the electrically insulated housing and away from the electrically insulated housing;

each said solder portion being arranged at the under side of the electrically insulated housing such that each said solder portion protrudes beyond the under side of the electrically insulated housing in a direction transverse to said longitudinal axis of the electrically insulated housing; and the under side of the electrically insulated housing, during soldering of the safety fuse element at a printed circuit board, confronting the printed circuit board.

13. The safety fuse element as defined in claim 2, wherein:

each of both ends of the hollow compartment is enlarged with respect to the central region of the hollow compartment to such an extent that each inserted tubular portion is internally aligned with the central region of the hollow compartment.

14. A safety fuse element, comprising:

an electrically insulated housing having an inner surface and a longitudinal axis;

said electrically insulated housing containing a hollow compartment open at opposite ends thereof and continuously extending along the longitudinal axis of the electrically insulated housing;

two electrically conductive end contacts connected with the electrically insulated housing;

each electrically conductive end contact being located at a region of a respective open end of the electrically insulated housing;

a fuse wire having oppositely situated ends;

said fuse wire being arranged within the electrically insulated housing and extending in the direction of the longitudinal axis of the electrically insulated housing;

each end of the fuse wire being electrically conductively connected with an associated one of the electrically conductive end contacts;

each electrically conductive end contact having an inner surface confronting the hollow compartment;

arc-inhibiting screen means essentially completely covering the inner surface of each of both end contacts; and said arc-inhibiting screen means extending from one of said two electrically conductive end contacts to the other of said two electrically conductive end contacts in order to enclose the hollow compartment, whereby electrical arcs formed in the hollow compartment are prevented from coming into contact with the inner surface of each of the end contacts and the inner surface of the electrically insulated housing.

15. A method of manufacturing a safety fuse element, comprising the steps of:

providing an electrically insulating housing having a hollow compartment and opposite ends;

inserting two completely tubular end contacts having inner surfaces into opposite ends of the electrically insulating housing and into the hollow compartment;

inserting an arc-inhibiting screen and a fuse wire extending through the arc-inhibiting screen into the hollow compartment of the electrically insulating housing and into the two tubular end contacts;

completely covering the inner surface of each of both end contacts and an inner surface of the electrically insulating housing by means of the arc-inhibiting screen in order to enclose the hollow compartment, whereby electrical arcs formed in the hollow compartment are prevented from coming into contact with the inner surface of each of the end contacts and the inner surface of the electrically insulated housing;

flattening a portion of each of the two tubular end contacts to form respective flat portions of the two tubular end contacts;

clamping at clamping locations, formed during flattening of the portions of the tubular end contacts, a respective end of the fuse wire;

bending away from the longitudinal axis of the electrically insulating housing at least a part of each flat portion of each end contact; and forming at each said bent portion a solder pin.

16. The method of manufacturing a safety fuse element as defined in claim 15, further including the step of:

clamping at the clamping locations, formed during flattening of the portions of the tubular end contacts, respective ends of the arc-inhibiting screen.

17. The method of manufacturing a safety fuse element as defined in claim 15, further including the step of:

using as the arc-inhibiting screen a substantially tubular screen.

* * * * *